US008023683B2

(12) United States Patent
Lin

(10) Patent No.: US 8,023,683 B2
(45) Date of Patent: Sep. 20, 2011

(54) TWEETER SOUND SOURCE ANGLE ADJUSTMENT ARRANGEMENT

(75) Inventor: Steff Lin, Taipei Hsien (TW)

(73) Assignee: Hi-Tech Sound System Co., Ltd., Taipei (TW)

( * ) Notice: Subject to any disclaimer, the term of this patent is extended or adjusted under 35 U.S.C. 154(b) by 1037 days.

(21) Appl. No.: 11/898,827

(22) Filed: Sep. 17, 2007

(65) Prior Publication Data

US 2009/0074225 A1 Mar. 19, 2009

(51) Int. Cl.
*H04R 1/02* (2006.01)

(52) U.S. Cl. ..... 381/387; 381/182

(58) Field of Classification Search ..... 381/387, 381/182

See application file for complete search history.

(56) References Cited

U.S. PATENT DOCUMENTS 6,282,297 B1 * 8/2001 Lin ..... 381/386
6,356,640 B1 * 3/2002 Lin ..... 381/182
2009/0046886 A1 * 2/2009 Lin ..... 381/395

* cited by examiner

*Primary Examiner* — Mark Prenty
(74) *Attorney, Agent, or Firm* — Bacon & Thomas, PLLC

(57) ABSTRACT

A tweeter sound source angle adjustment arrangement is disclosed to include a holder member fastened to a T-iron of a speaker assembly and having a top recess and a through hole cut through the top recess, a face panel fastened to the holder member to secure a tweeter to the top recess of the holder member, a hub, which has a top round cup portion and a tubular bottom shank downwardly extending from the top round cup portion, a cushion ring set between the face panel and the hollow hub, and a sliding ring set in the top round cup portion of the hub and freely rotatable in the top round cup portion of the hub.

4 Claims, 3 Drawing Sheets

TWEETER SOUND SOURCE ANGLE ADJUSTMENT ARRANGEMENT

BACKGROUND OF THE INVENTION

1. Field of the Invention

The present invention relates to speakers and more particularly, to a tweeter sound source angle adjustment arrangement that allows easy adjustment of the sound source direction of the tweeter.

2. Description of the Related Art

A speaker assembly may be equipped with a tweeter to produce high frequencies, enhancing the sound quality. A conventional speaker assembly with tweeter is known comprising an adjustment carrier carrying the tweeter. The adjustment carrier can be turned forwards, backwards, leftwards, and rightwards to adjust the angle of the tweeter. When adjusting the adjustment carrier, the tweeter is diverted from the axial alignment, affecting the tone quality.

Therefore, it is desirable to provide a speaker assembly that allows the user to adjust the direction of the sound source of the tweeter conveniently without biasing the center of the tweeter, thereby maintaining the quality.

SUMMARY OF THE INVENTION

The present invention has been accomplished under the circumstances in view. It is therefore the main object of the present invention to provide a tweeter sound source angle adjustment arrangement, which is easy and convenient to install and, allows easy adjustment of the sound source direction of the tweeter to maintain the sound quality of the speaker assembly.

According to one aspect of the present invention, the tweeter sound source angle adjustment arrangement comprises a holder member fastened to a T-iron of a speaker assembly and having a top recess and a through hole cut through the top recess, a face panel fastened to the holder member to secure a tweeter to the top recess of the holder member, a hub, which has a top round cup portion and a tubular bottom shank downwardly extending from the top round cup portion, a cushion ring set between the face panel and the hollow hub, and a sliding ring set in the top round cup portion of the hub and freely rotatable in the top round cup portion of the hub.

According to another aspect of the present invention, the tweeter sound source angle adjustment arrangement further comprises a locating block mounted in the bottom side of the T-iron of the speaker assembly, and a screw bolt inserted through the through hole of the holder member and a magnet and a washer and fastened to the locating block to secure the holder member to the T-iron.

According to still another aspect of the present invention, the face panel comprises a plurality of hooks hooked on the tweeter to secure the tweeter to the top recess of the holder member.

According to still another aspect of the present invention, the hub further comprises an inside annular flange extending around the inside wall corresponding to the connection area between the top round cup portion and the tubular bottom shank for stopping the sliding ring from escaping out of the round top cup portion of the hub.

DETAILED DESCRIPTION OF THE PREFERRED EMBODIMENT

Figure 1:
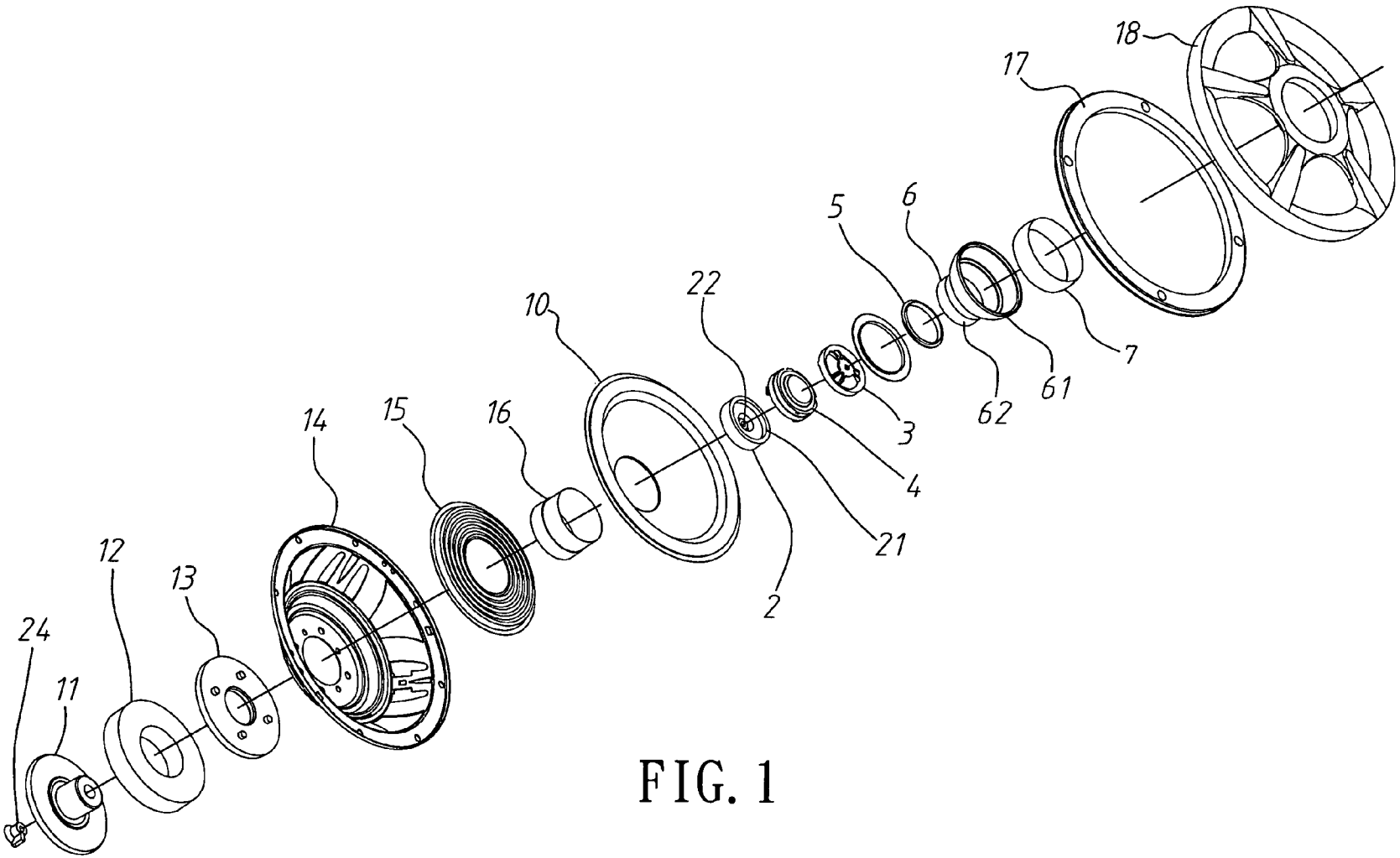
FIG. 1 is an exploded view of the preferred embodiment of the present invention.
Figure 2:
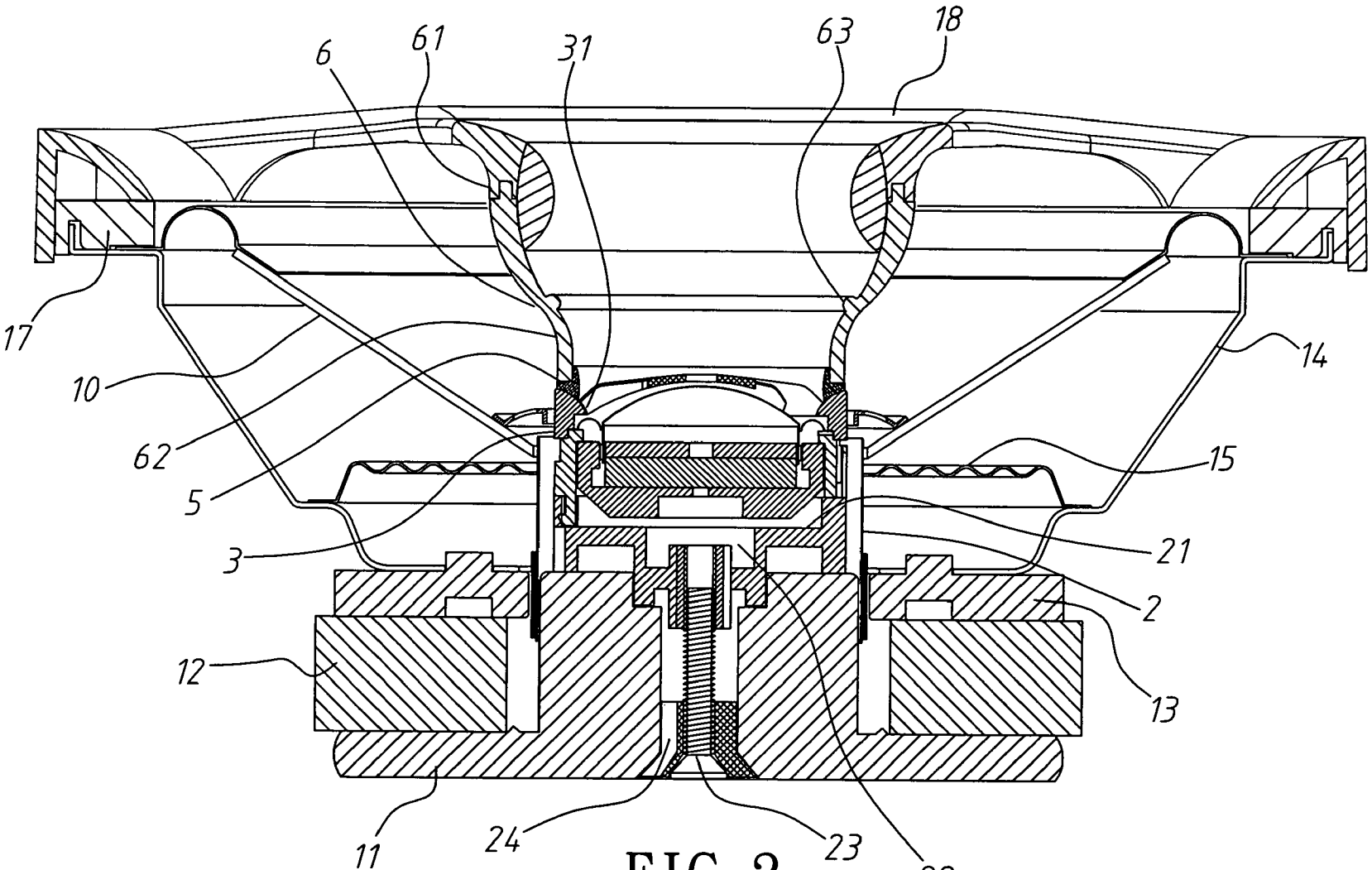
FIG. 2 is a sectional view of the preferred embodiment of the present invention.

Referring to FIGS. 1 and 2, similar to a regular speaker assembly, the present invention comprises a T-iron 11, a magnet 12, a washer 13, a bracket 14, a damper 15 at the bracket 14, a voice coil 16, at the center of the damper 15, a cone paper 10, and a cushion 17 at the top, and an grille 18. Setting between the voice coil 16 and the grille 18, the invention further comprises:

a holder member 2, which has a top recess 21 and a through hole 22 cut through the top recess 21;

a locating block 24 mounted in the bottom side of the T-iron 11;

a screw bolt 23 inserted through the through hole 22 of the holder member 2 and the magnet 12 and the washer 13 and fastened to the locating block 24 to secure the holder member 2 to the T-iron 11;

a face panel 3, which has hooks 31 for hooking on a tweeter 4 to secure the tweeter 4 to the top recess 21 of the holder member 2;

a hub 6 comprises a top round cup portion 61, a tubular bottom shank 62 downwardly extending from the bottom side of the top round cup portion 61 around the center through hole (not shown) of the top round cup portion 61, and an inside annular flange 63 extending around the inside wall corresponding to the connection area between the top round cup portion 61 and the tubular bottom shank 62;

a cushion ring 5 set between the face panel 3 and the hollow hub 6; and a sliding ring 7 set in the top round cup portion 61 of the hub 6 and freely rotatable in the top round cup portion 61.

After mounting of the sliding ring 7 in the top round cup portion 61 of the hub 6, the sliding ring 7 is freely rotatable in the top round cup portion 61, and the inside annular flange 63 prohibits escaping of the sliding ring 7 out of the top round cup portion 61 of the hub 6 during its rotary motion, thereby keeping the tweeter 4 in accurate alignment and maintaining the tone quality of the speaker assembly.

Figure 3:
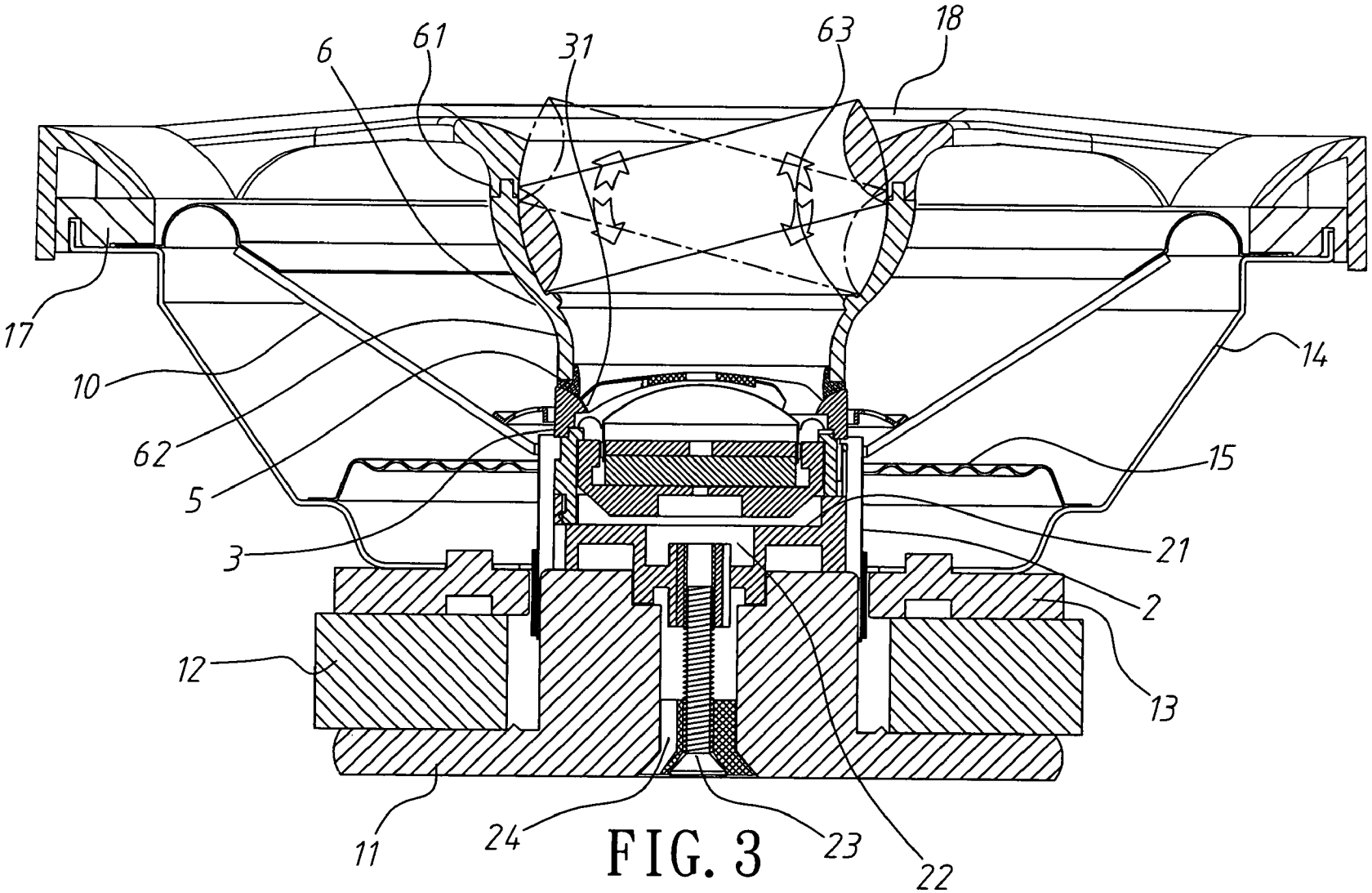
FIG. 3 is a schematic view of the preferred embodiment of the present invention, showing the speaker in operation.

Referring to FIG. 3, when adjustment of the angle of the tweeter 4 is necessary during the use of the speaker assembly, rotate the sliding ring 7 (press the finger on one side of the sliding ring 7 to move the sliding ring 7) to change the direction of the hub 6. During position adjustment of the sliding ring 7, the inside annular flange 63 prohibits the sliding ring 7 from escaping out of the top round cup portion 61 of the hub 6.

After adjustment of the direction of the hub 6, the sound source direction of the tweeter 4 is relatively changed. Therefore, the adjustment of the sound source direction of the tweeter 4 is quite simple and convenient, and the tweeter 4 is constantly kept in accurate alignment without causing distortion.

A prototype of tweeter sound source angle adjustment arrangement has been constructed with the features of FIGS. 1~3. The tweeter sound source angle adjustment arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A tweeter sound source angle adjustment arrangement, comprising:

a holder member fastened to a T-iron of a speaker assembly, said holder member having a top recess and a through hole cut through said top recess;

a face panel fastened to said holder member to secure a tweeter to the top recess of said holder member;

a hub, said hub comprising a top round cup portion, a tubular bottom shank downwardly extending from a bottom side of said top round cup portion;

a cushion ring set between said face panel and said hollow hub; and a sliding ring set in the top round cup portion of said hub and freely rotatable in the top round cup portion of said hub.

2. The tweeter sound source angle adjustment arrangement as claimed in claim 1, further comprising a locating block mounted in a bottom side of said T-iron of said speaker assembly, and a screw bolt inserted through the through hole of said holder member and a magnet and a washer and fastened to said locating block to secure said holder member to said T-iron.

3. The tweeter sound source angle adjustment arrangement as claimed in claim 1, wherein said face panel comprises a plurality of hooks hooked on said tweeter to secure said tweeter to the top recess of said holder member.

4. The tweeter sound source angle adjustment arrangement as claimed in claim 1, wherein said hub further comprises an inside annular flange extending around an inside wall thereof corresponding to the connection area between said top round cup portion and said tubular bottom shank for stopping said sliding ring from escaping out of the round top cup portion of said hub.

* * * * *